US005455604A

United States Patent [19]

Adams et al.

[11] Patent Number: 5,455,604

[45] Date of Patent: Oct. 3, 1995

[54] INK JET PRINTER ARCHITECTURE AND METHOD

[75] Inventors: Ronald L. Adams, Portland, Oreg.; Charles Bradford, Garland, Tex.; Edward F. Burke, Lake Oswego, Oreg.; Eldon P. Hoffman; Rodney B. Gilbert, both of West Linn, Oreg.; James D. Rise, Beaverton, Oreg.; Arthur C. Van Horne, Lake Oswego, Oreg.

[73] Assignee: Tektronix, Inc., Wilsonville, Oreg.

[21] Appl. No.: 290,441

[22] Filed: Aug. 15, 1994

Related U.S. Application Data

[63] Continuation of Ser. No. 715,063, Jun. 12, 1991, abandoned, which is a continuation-in-part of Ser. No. 692,841, Apr. 29, 1991, Pat. No. 5,121,139.

[51] Int. Cl.[6] ..... B41J 2/01; B41J 13/22; B41J 15/16

[52] U.S. Cl. ..... 346/138; 346/136; 347/104; 271/277; 101/409; 100/618

[58] Field of Search ..... 347/88, 104; 346/136, 346/138, 125, 132; 271/275, 277; 400/618, 659, 662; 101/409

[56] References Cited

U.S. PATENT DOCUMENTS

| | | | |
|---|---|---|---|
| 3,293,059 | 12/1966 | Stowell | 346/153.1 X |
| 4,225,872 | 9/1980 | Marinoff | 346/138 X |
| 4,317,138 | 2/1982 | Bryan et al. | 358/291 |
| 4,386,771 | 6/1983 | Lakdawala | 271/82 |
| 4,390,176 | 6/1983 | Kato | 346/138 X |
| 4,581,618 | 4/1986 | Watanabe et al. | 346/134 |
| 4,707,704 | 11/1987 | Allen et al. | 346/24 |
| 4,761,664 | 8/1988 | Piatt et al. | 346/134 |
| 4,761,665 | 8/1988 | Piatt et al. | 346/140 R |
| 4,779,099 | 10/1988 | Lewis | 346/1.1 |
| 4,796,035 | 1/1989 | Kawasaki et al. | 346/108 |
| 4,815,870 | 3/1989 | Sparer et al. | 400/120 |
| 4,943,045 | 7/1990 | Van Horne et al. | 346/138 X |
| 4,982,207 | 1/1991 | Tunmore et al. | 346/138 |
| 5,087,930 | 2/1992 | Roy et al. | 347/71 X |
| 5,092,235 | 3/1992 | Rise | 100/168 |
| 5,121,139 | 6/1992 | Burke | 346/138 |
| 5,262,804 | 11/1993 | Petigrew et al. | 347/88 X |

OTHER PUBLICATIONS

Buddington, D. et al, "Paper Drum Tensioning Rollers", IBM Technical Disclosure Bulletin, vol. 19, No. 9, Feb. 1977, p. 3471.

*Primary Examiner*—Benjamin R. Fuller
*Assistant Examiner*—Alrick Bobb
*Attorney, Agent, or Firm*—Ralph D'Alessandro

[57] ABSTRACT

A printer accurately controls the passage of print media therethrough and maintains the print media taut as the print media passes through a printing zone while the media is printed by an ink jet printer. The print media sheet is preferably carried by a rotating drum in a first direction through the printing zone, with the drum being reversed to cause the exiting of the print media sheet from the printer. A pressure fixing or fusing apparatus may be positioned to flatten ink spots on the print media as the print media exits from the printer. The pressure fixing or fusing mechanism is preferably used in the case of a hot-melt or phase-change ink jet printer.

9 Claims, 10 Drawing Sheets

INK JET PRINTER ARCHITECTURE AND METHOD

RELATED APPLICATION

This is a continuation of application Ser. No. 07/715,063 filed Jun. 12, 1991 now abandoned, which is a continuation-in-part of U.S. patent application Ser. No. 07/692,841, filed Apr. 29, 1991, now U.S. Pat. No. 5,121,139, issued Jun. 9, 1992.

TECHNICAL FIELD

The present invention relates to ink jet printers and more particularly to the overall architecture of a print media transport path through a printer and to a method of printing such media.

BACKGROUND OF THE INVENTION

Ink jet printers, and in particular, drop-on-demand ink jet printers having print heads with acoustic drivers for ink drop formation are well known in the art. The principle behind an impulse ink jet of this type is the generation of a pressure wave in an ink chamber and subsequent emission of ink droplets from the ink chamber to a nozzle orifice as a result of the pressure wave. A wide variety of acoustic drivers have been employed in ink jet print heads of this type. For example, the drivers may consist of a transducer formed by piezoceramic material bonded to a thin diaphragm. In response to an applied voltage, the diaphragm displaces ink in the ink chamber and causes a pressure wave and the flow of ink to one or more nozzles. Other types of acoustic drivers for generating pressure waves in ink include heater-bubble source drivers (so called bubble jets) and electromagnet solenoid drivers.

Known ink jet printers typically combine an ink jet print head from which drops of ink are ejected toward print media with a reservoir for supplying ink, including plural colors of ink, to various nozzles of the ink jet print head. Also, it is common to shuttle or scan ink jet print heads transversely across print media as the print media is being printed by the ink jet print head.

In a typical application, print media is delivered to a drum and secured to the drum for subsequent printing by a mechanism such as a clamp which grips one edge of the print media. As the drum rotates past the print location, ink is ejected from the ink jet print head onto the print media to accomplish the printing. In a typical printing arrangement, the print media is in effect printed in rows of pixels, each pixel or picture element having a predetermined size and height. The height of the pixel element corresponds to a distance along the print media in the direction of rotation of the drum.

For accurate printing, precise control of the transportation of print media through a printer is required. Any slack in the print media during printing and errors in advancing the print media through the print media transport path can cause a degradation in print quality.

One prior art printer is described in U.S. Pat. No. 4,386,771 to Lakdawala. This patent describes a gripping bar which opens to receive the edge of a sheet of media and closes to hold the sheet onto a drum. The drum is initially rotated in a first direction. The use of a printing means such as a moving head electrographic printer or an array of stationary thermoprinters is mentioned. To eject a sheet of print media from the drum, the direction of drum rotation is reversed with the free edge of the surface of the sheet lifting off the drum by the beam strength of the sheet, the free edge being the edge opposite the gripped edge. The free edge is delivered to a sheet stripper which guides the sheet away from the drum, the stripper being shown in this patent as being located close to the 12 o'clock position of the drum.

U.S. Pat. No. 4,317,138 to Bryan et al. discloses a method and apparatus for facsimile sheet handling in which a first edge of a sheet is transported to a clamp on a drum. The drum is rotated in a first direction during scanning. A roller is positioned against the drum and the drum rotation is reversed to remove the sheet from the drum. This roller is spaced from the drum during the scanning operation.

In each of these references, inasmuch as the clamp is the only mechanism understood to be used to hold the sheet on the drum during scanning, inaccuracies in printing can result.

Another exemplary printer is shown in U.S. Pat. No. 4,581,618 to Watanabe, et al. In Watanabe, print media is fed by a roller mechanism to a first pinch roller which bears against a drum. This drum is described as a platen of high friction material, such as rubber. Soft rubber rollers would not have a radius within a narrow precision, particularly at locations where engaged by other rollers. A motor 10, described as a "feed pulse" motor, is used to drive the drum and the paper transport mechanism of the printer. An elaborate multiple gear drive system is used to couple the motor to the drum and other paper transport rollers of the system. At the appropriate time, print media is transferred from the first roller to the drum, with the print media being retained on the drum by a movable pinch roller illustrated in this patent as having a gap in its center. The movable pinch roller retains the paper on the drum by torque established by a friction clutch. During printing, the drive mechanism is described as rotating the drum through a predetermined angle after the printing of each line of print.

Because gears are used in the paper transport mechanism of this device, backlash may occur which can result in inaccuracies of print media positioning during the printing operation. Also, since gears typically have very few teeth which engage one another at any given time, variations in the configuration of particular teeth on a gear translate to inaccuracies in the transportation of print media through the printer. In addition, a drive mechanism relying on a multiplicity of gears is subject to wear and mechanical failure.

U.S. Pat. No. 4,707,704 to Allen, et al. mentions the use of a stepper motor for driving a drum of an ink jet printer. In this patent, the stepper motor is shown coupled directly to the shaft of the drum. With this construction, the inertia of the drum is applied directly to the motor shaft and can cause a very poor inertia match between the motor and the load on the motor. In addition, this patent discloses a print media transport path in which a roll of print media is positioned within a drum and moved by an internal roller, including one covered with resilient material, to the exterior of the drum for printing purposes.

Prior art printers have also employed numerous types of clamps for securing print media to a drum during printing operations. U.S. Pat. No. 4,815,870 to Sparer, et al. discloses a sheet clamp for a thermal printer drum in which the clamp is positioned within a recess of the drum. The drum is rotated in one direction during printing and in a reverse direction during sheet ejection.

The use of pressure fixing rollers for fusing or spreading phase change or hot-melt ink on print media is also known.

Japanese Patent No. 18,351 to Moriguchi, et al., U.S. Pat. No. 4,745,420 to Gerstenmeier and U.S. Pat. No. 4,889,761 to Titterington, et al. are examples. Other examples of prior art image fixing apparatus including rollers are described in U.S. Pat. Nos. 3,293,059 to Sole, 3,566,076 to Fantuzzo and 4,568,949 to Muranaka. These existing fusing rollers typically apply an extremely high loading force along the line of contact between fusing rollers, such as 100 lbs. per lineal inch. In this case, for a ten inch long roller, 1,000 lbs. of force must be applied to the rollers.

Although a number of ink jet printers are known, a need exists for an improved ink jet printer which is capable of overcoming these and other disadvantages of the prior art.

SUMMARY OF THE INVENTION

In accordance with the present invention, a method of printing sheets of print media with ink from an ink jet print head having at least one orifice from which ink is ejected toward the print media is disclosed. Each sheet of media has a first edge, a second edge opposed to the first edge, and a pair of transversely spaced apart side edges. In accordance with one aspect of the invention, the method comprises the steps of transporting the print media in a first direction to the entry to a printing zone, through the printing zone, and from an exit of the printing zone with ink being ejected from an ink jet print head onto the print media while the media is in the printing zone. Tension is applied to the print media adjacent to the printing zone so as to draw the print media taut as it is transported through the printing zone during printing.

As a more specific aspect of the present invention, the transportation step comprises a step of clamping the first edge of the print media to a drum and rotating the drum in a first direction, the drum drawing the print media through the print zone with the tension resisting the motion of the drum to thereby draw the media taut. Tension may be applied by positioning a tensioning blade against the print media and drum, the blade extending transversely across the print media. The method may also include the step of pivoting the blade away from the drum to permit the travel of the clamp in the first direction past the blade before pivoting the blade against the media and drum.

As yet another aspect of the present invention, the blade may be pivoted away from the drum with the direction of rotation of the drum being reversed to deliver the second edge of the print media to a print media exit path, the clamp being released to permit the exiting of the print media along the exit path.

As a still further aspect of the present invention, the print media may be pressure fused or fixed as it passes along the exit path.

One apparatus in accordance with the invention for carrying out the above method includes a print media carrying drum rotatable in respective first and second directions. A print media receiving clamp on the drum is operable to receive the first edge of the print media and to releasably clamp the first edge to the drum. Following delivery of the sheet of print media to the clamp, the drum is rotated in a first direction to transport the print media through the printing zone with a tensioning blade applying back tension to the print media at a location ahead of the printing zone. The drum is rotated in a second direction opposite to the first direction to deliver the second edge of the print media to the exit path. A pressure fuser or fixing apparatus may be disposed in the exit path for fusing ink spots on the print media as the print media exits from the drum.

It is accordingly an overall object of the present invention to provide an improved ink jet printer apparatus and an improved method for printing print media.

These and other objects, features and advantages of the present invention will become apparent with reference to the following drawings and detailed description.

DETAILED DESCRIPTION OF A PREFERRED EMBODIMENT

Figure 2:
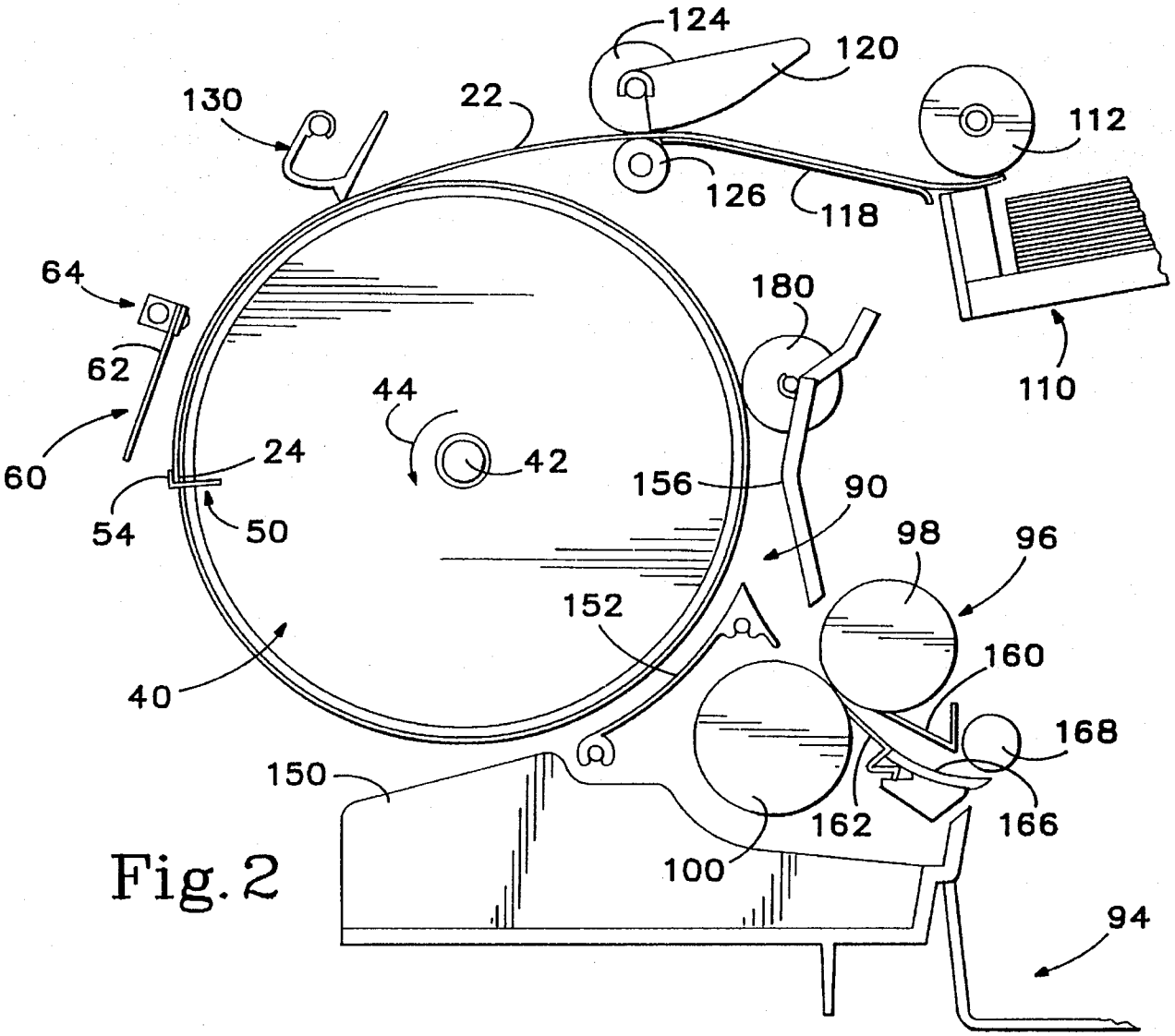
Figure 3:
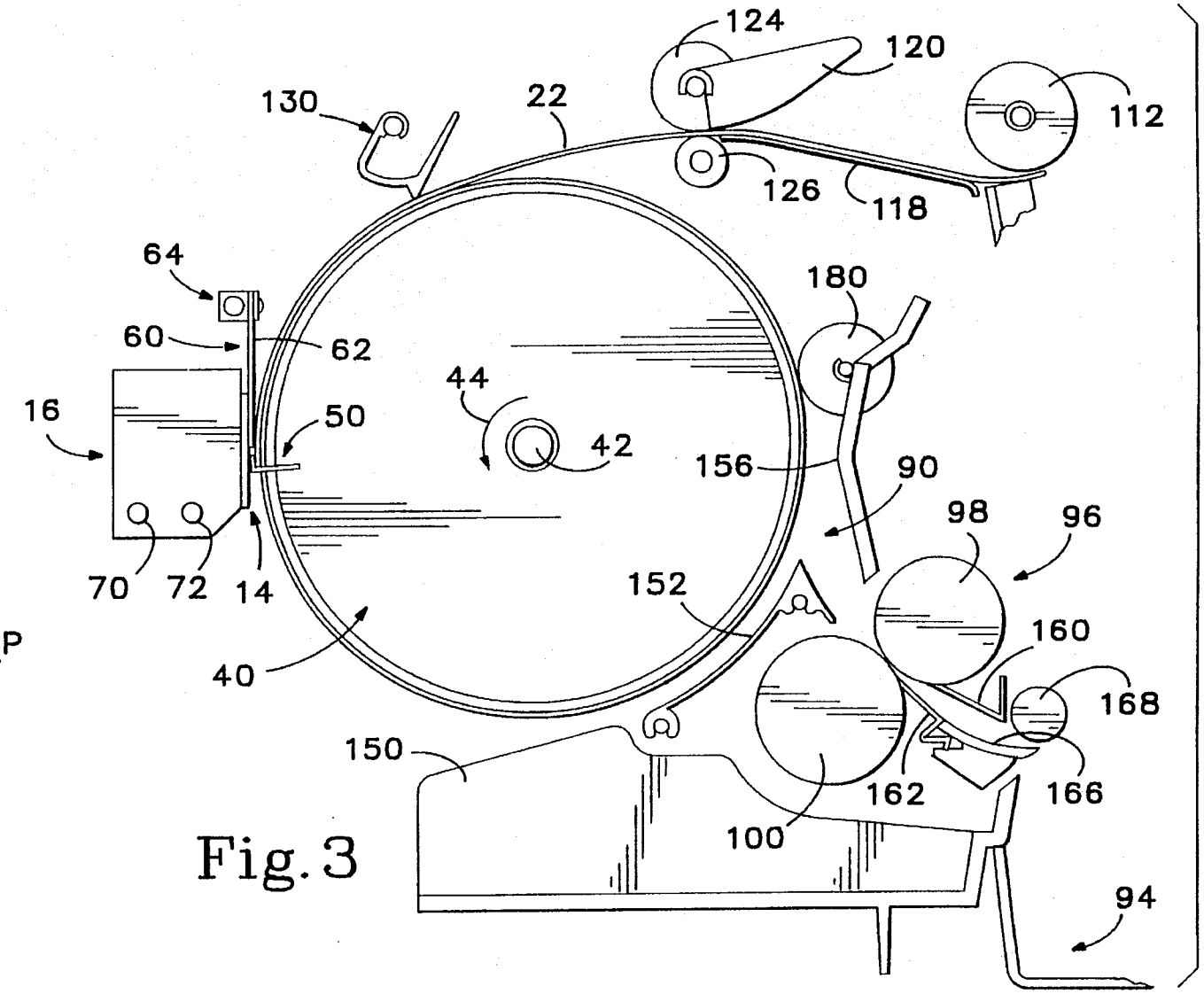
Figure 4:
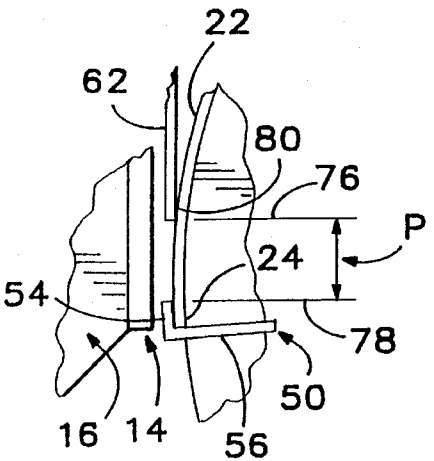
FIG. 4 is an enlarged schematic illustration of an ink jet print head in position for ejecting ink toward print media in a printing zone.
Figure 6:
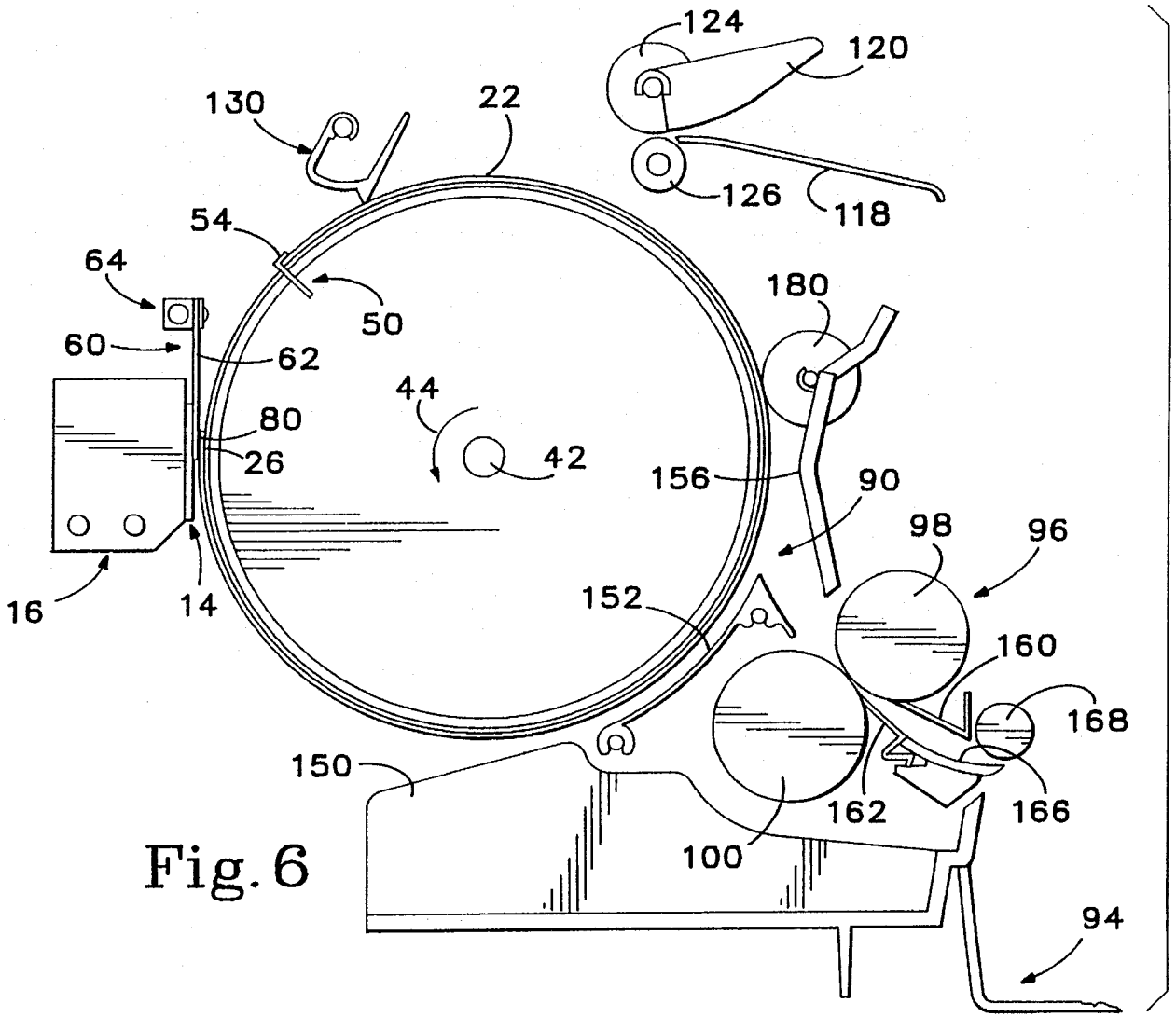
Figure 5:
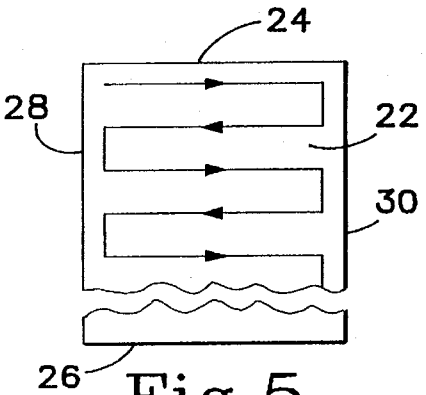
FIG. 5 is a schematic illustration of a sheet of print media showing one pattern of printing of ink drops onto the print media.
Figure 7:
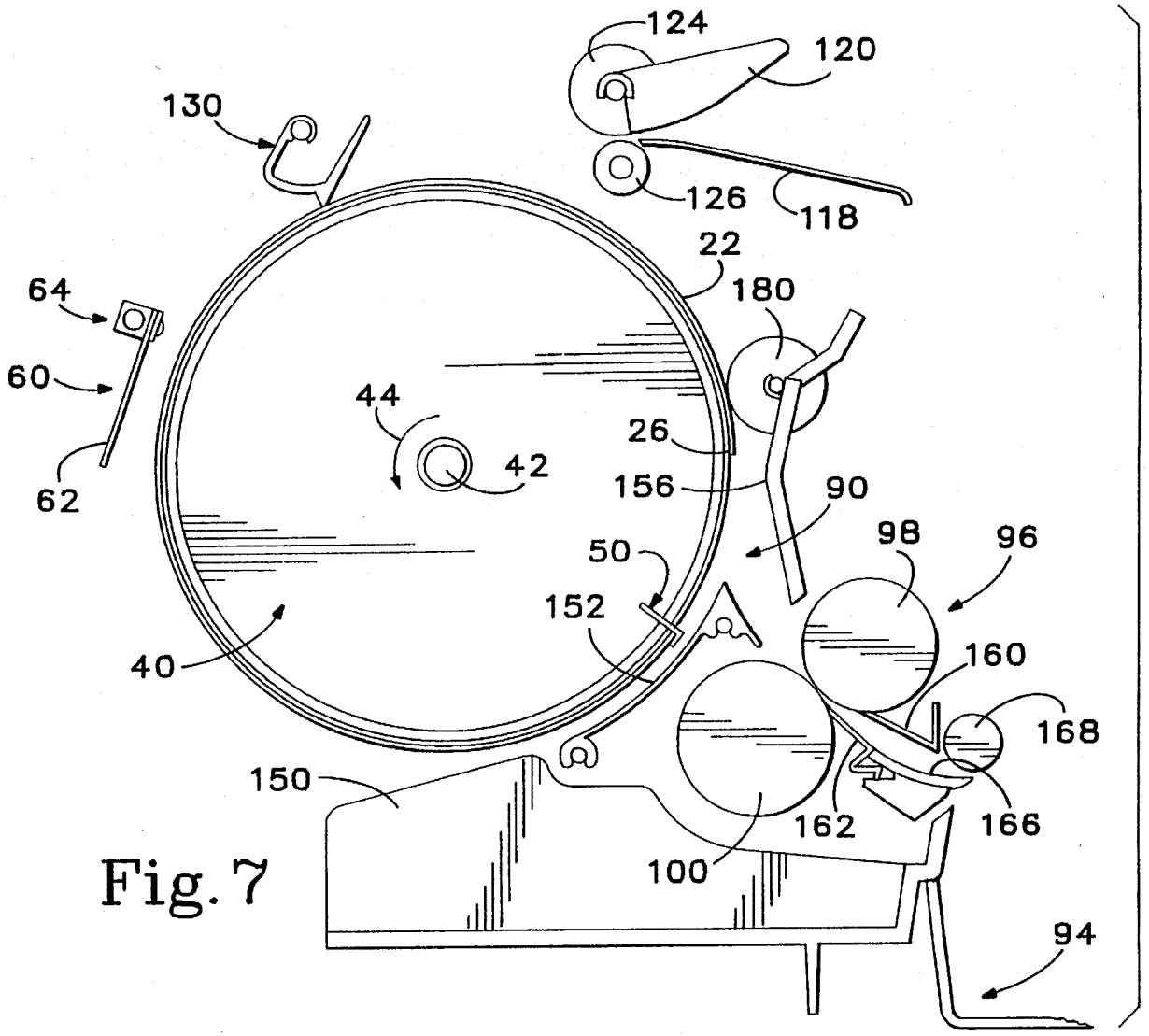
Figure 8:
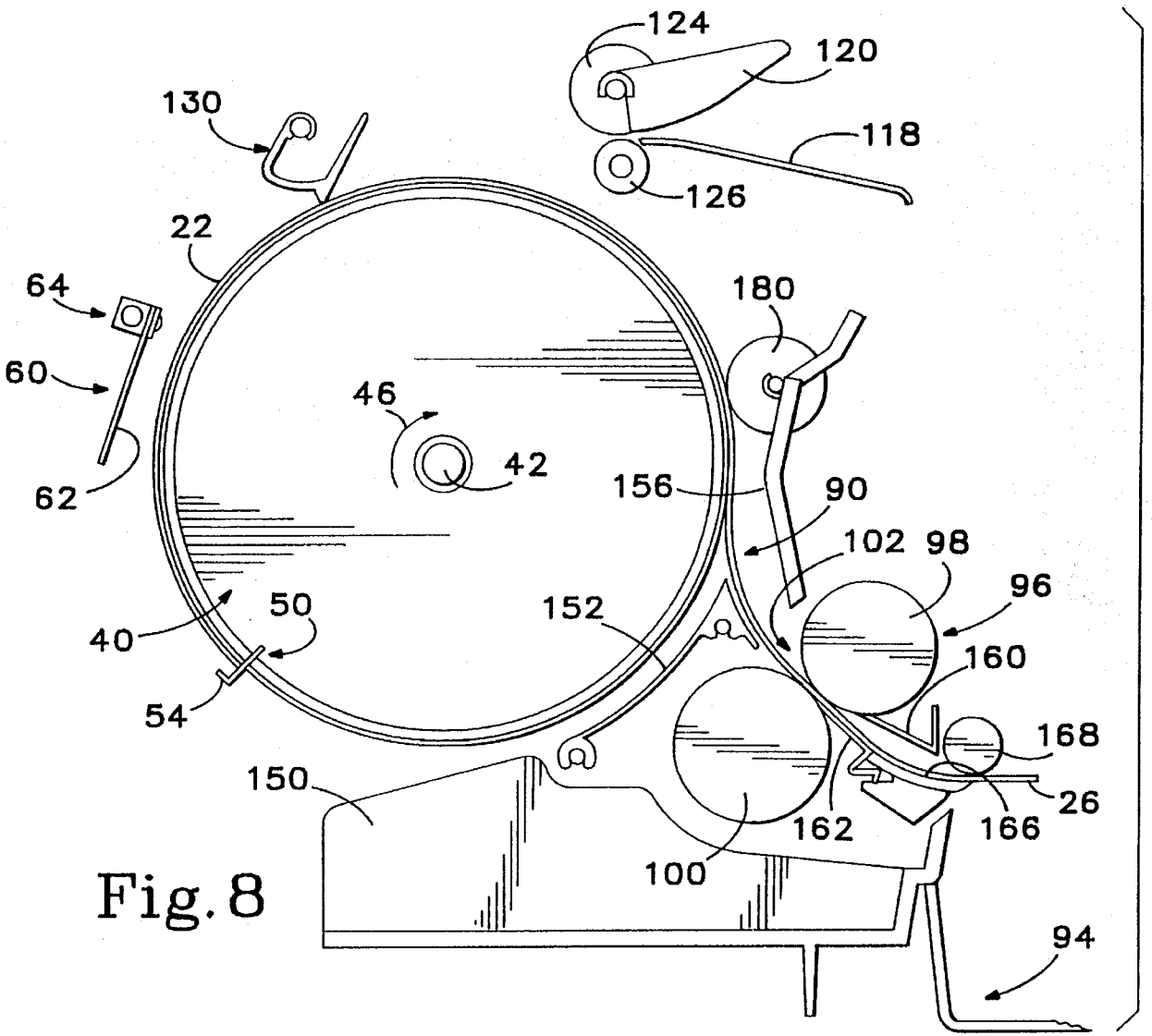

With reference to FIGS. 1–5, the printer has an ink jet print head 14 mounted to an ink containing reservoir system 16 which supplies ink to the ink jet print head. The ink jet print head includes an ink drop ejection orifice, and preferably plural orifices, not shown, from which ink drops are ejected toward ink drop receiving print media such as the sheet of print media indicated at 22 in each of these figures. It should be noted that print media 22 may be of any suitable material, including paper, transparencies and any other form of sheet stock. As best seen in FIGS. 4 and 5, the print media sheet 22 has a first edge 24 and opposed second edge 26 and a pair of transversely spaced apart side edges 28, 30.

Figure 1:
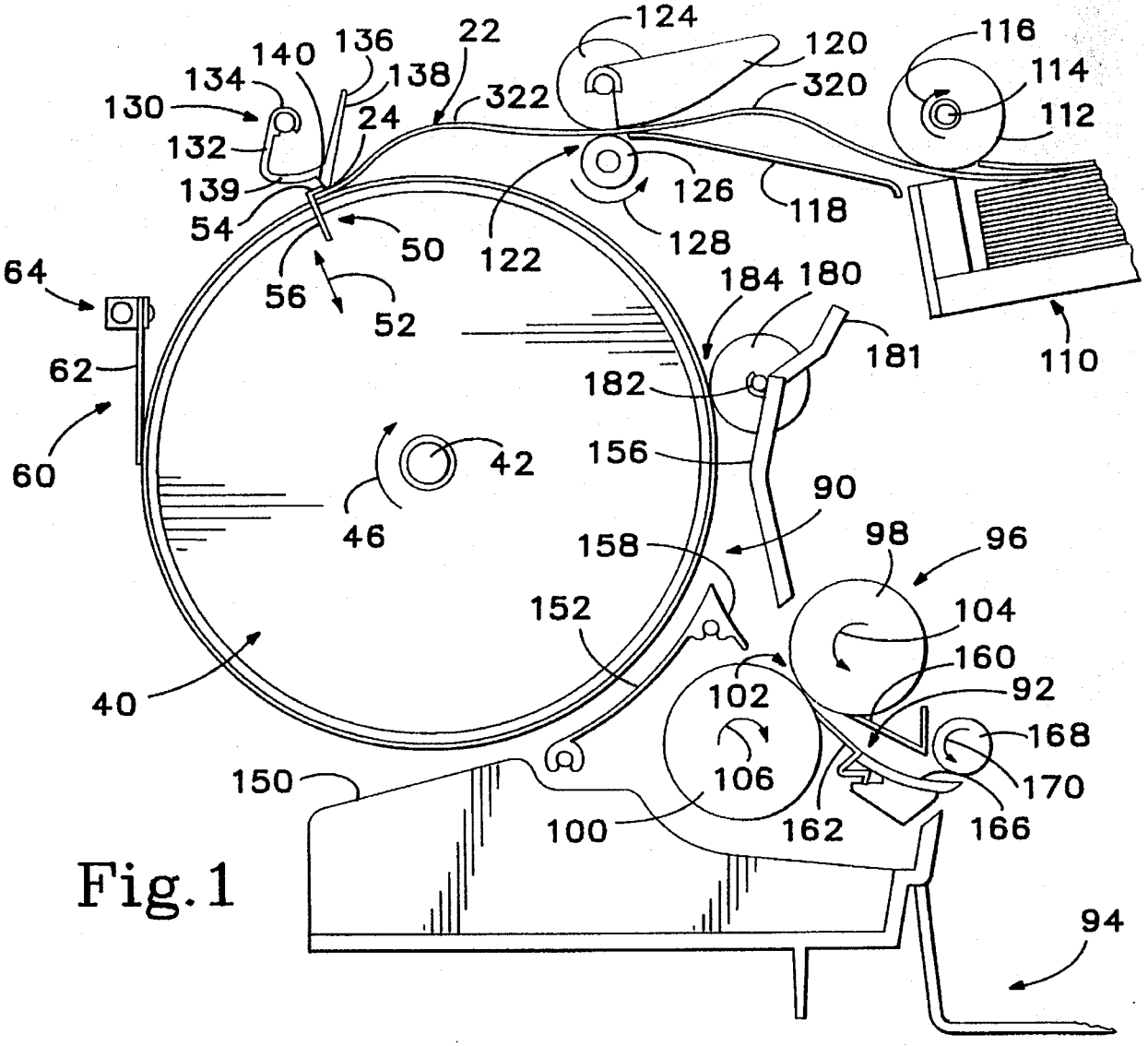
FIGS. 1–3 and 6–8 are side elevational views of one form of an ink jet printer apparatus in accordance with the present invention at various positions during the printing of a sheet of print media.
Figure 11:
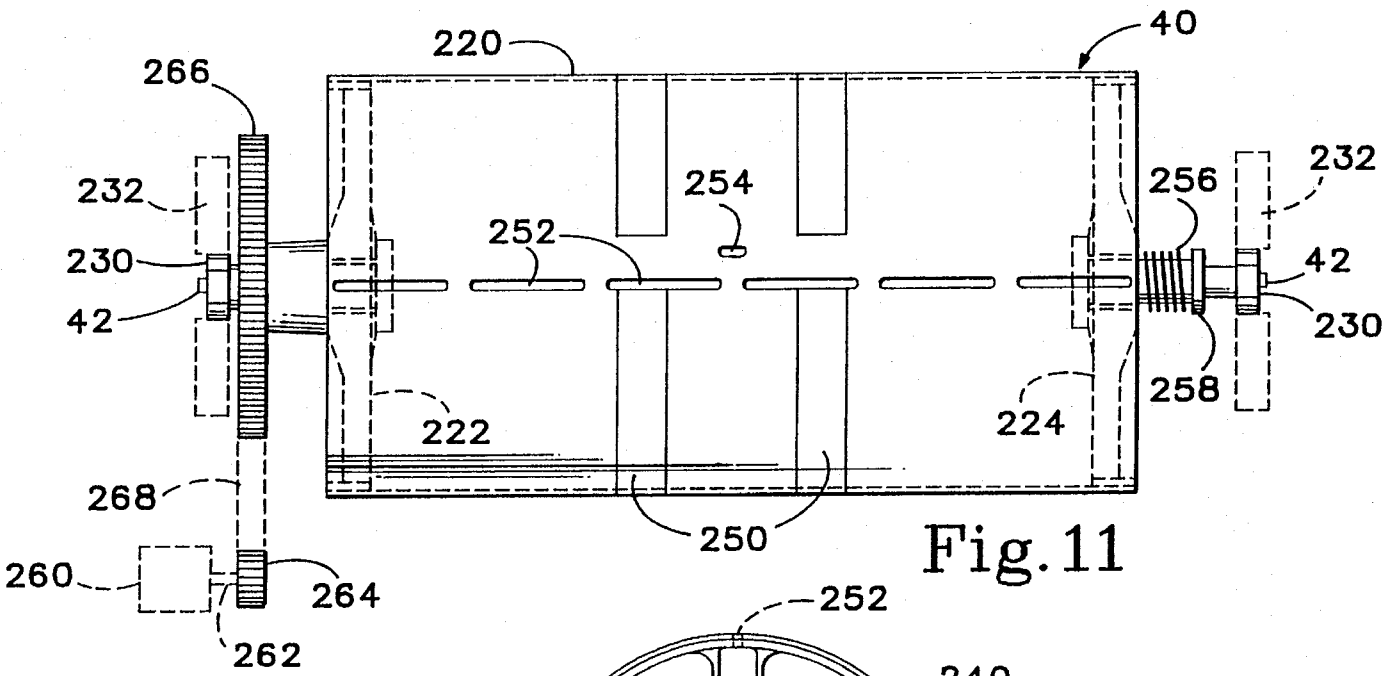
FIG. 11 is a top plan view of one form of a print media carrying drum utilized in the present invention.
Figure 12:
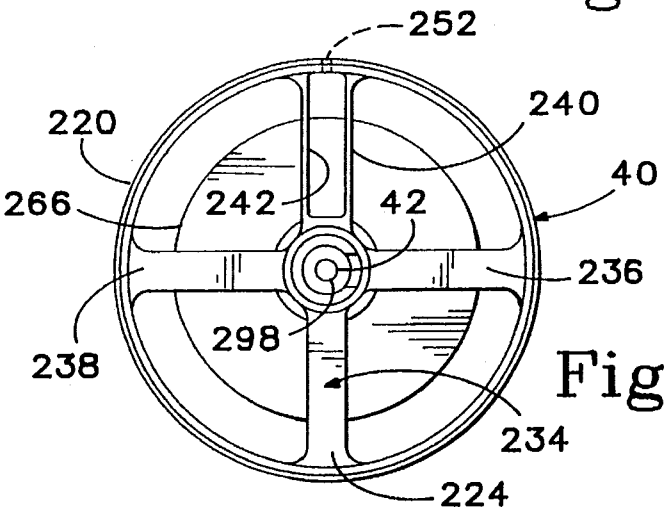
FIG. 12 is an end view of the drum of FIG. 11.

The printer apparatus includes a drum 40 having a central shaft 42 rotatably mounted, by bearings not shown in these figures, to the printer framework so as to permit rotation of the drum 40 about the longitudinal axis of shaft 42 in a first direction indicated by arrow 44 in FIG. 2 and in an opposite or second direction indicated by arrow 46 in FIG. 1. A suitable drive mechanism, such as described in greater detail below in connection with FIGS. 11 and 12, is used to selectively rotate the drum in the respective first and second directions 44, 46 during the printing operation. A clamp 50, one suitable form of which is described in greater detail below (see FIGS. 13 and 14), is operable to receive and clamp the first edge 24 of the print media against the drum. The illustrated clamp 50 is generally L-shaped with a stem portion 56 and a print media edge grip or gripping portion 54. Upon movement of the clamp 50 in the respective radial directions, as indicated by arrow 52, the gripping element 54 is respectively opened (spaced from the drum surface) or closed (drawn against the drum surface) to correspondingly release and clamp the print media.

The apparatus also includes a biasing mechanism for applying a back tension to the print media while the media is being carried by the drum. Although other forms of biasing mechanisms may be used, such as friction roller with a slip clutch, a preferred tensioning mechanism comprises a tensioning blade assembly 60 having an elongated blade 62 which extends transversely across the print media supporting portions of the drum and thus from side to side of print media carried on the drum. The blade 62 is mounted by a support 64 to the printer frame. Preferably the blade is supported for shifting movement into and out of engagement with print media carried by the drum (compare, for example, FIGS. 1 and 2). More specifically, the illustrated support 64 pivotally mounts the blade to the frame for pivoting against and away from the drum to respectively apply tension to and relieve tension from print media on the drum. The blade 62 may be shifted away from the drum to permit passage of the clamp 50 beneath the blade and also during removal of the print media from the drum.

As illustrated in FIGS. 3 and 4, the ink jet print head, and in this case the reservoir assembly 16, is mounted to a pair of rails 70, 72 and is driven in a conventional manner by a motor, not shown, transversely across the sheet of print media, between the sides 28 and 30 thereof, to scan the media during the printing operation. The ink jet print head 14 ejects ink toward print media 22 while the print media is positioned in a print zone indicated at P in FIG. 4. Thus, as print media enters the print zone at location 76 in FIG. 4, the print media may be printed with ink drops from the ink jet print head. This printing may continue as the print media passes through the zone P, the print media being transported through the zone by rotation of the drum 40 in the direction of arrow 44, until the print media exits from the printing zone at the location indicated by the number 78 in FIG. 4.

The tensioning blade 62 engages the print media at a location 80 which is adjacent to the entry 76 to the print zone. Therefore, as shown in FIG. 4, as the clamped print media is drawn through the print zone, by the rotation of the drum, the back tension applied by the blade 62, which typically ranges from about 0.5 oz. to 5 oz. and most preferably is at about 1 oz., draws the print media taut in the print zone. As a result, irregularities in printing caused by variations in print media slackness in the print zone are substantially eliminated. For purposes of this specification, the term "adjacent to the print zone" means from about 0.02 inch to about 0.06 inch from the entry to the print zone, the entry to the print zone being defined as the location at which ink can first be applied to the print media as the media enters the print zone. Most preferably, it has been found that the back tension should be applied within about 0.03 inch of the entry to the print zone.

As previously mentioned, the ink jet print head 14, and the reservoir 16, if directly supporting the ink jet print head, may be mounted for shuttling or reciprocating across the surface of the print media. This shuttling motion is typically in a direction skewed with respect to, and more typically substantially orthogonal to, the direction of advancement of the print media 22 by the drum 40.

The ink jet print head may take any form and may be of the drop-on-demand type, wherein droplets are only ejected in response to the state of energization of an associated transducer. Ink jet print head 14 may also be of a continuous type and optionally may be provided with an air assist for accelerating the delivery of ink drops toward the print media 22. One suitable ink jet print head is described in U.S. Pat. No. 4,727,378 to Le, et al. Ink jet print heads of the type having nozzle orifices arranged in an array may also be used. One such ink jet print head of this type is disclosed in U.S. Pat. No. 5,087,930 to Roy, et al., and incorporated herein by reference.

Each of these ink jet print heads utilizes acoustic drivers, and more specifically piezoceramic materials, for generating a pressure wave in the ink jet print head in response to drive signals. These pressure waves cause the ejection of ink drops from associated nozzle orifice openings on demand. Addressabilities of 300 dots/inch or more can be achieved using ink jet print heads of this type. Also, these ink jet print heads may be utilized for ejecting drops of hot-melt or phase-change ink toward print media, as well as for ejecting non-hot-melt ink, such as aqueous ink. In the case of hot-melt ink jet printers, heaters are included to heat the ink reservoir and ink jet print head to maintain the ink in a liquid state for jetting purposes. Ink drops or spots are thus applied to the print media during printing. If the ink is of the hot-melt type, the ink spots undergo a liquid to solid phase transition on the media. Also, the dots project somewhat from the surface of the media when solidified. Certain types of media, such as transparencies, are not significantly penetrated by the ink drop impinging thereon. As a result, for such media, the drops of solidified hot-melt ink tend to project a greater degree from the media than in the case of other types of more porous media, such as plain paper. In the subtractive primary system of ink jet printing, secondary colors (red, green and blue) are achieved by jetting drops of two primary colors on top of one another. In the case of phase-change inks, this results in areas being covered with different thicknesses of ink. This area of the media should be contrasted with areas in the media containing a single layer of ink.

When hot-melt ink is utilized, advantages can be achieved by fixing or fusing the ink on the print media. In general, this involves applying sufficient pressure to the deposited ink drops on the print media to spread the ink drops even in cases where ink layers are present on the media in different thicknesses.

Referring again to FIGS. 1–5, the illustrated printer has an exit 90 leading to an exit path 92 which in turn terminates at an exit tray 94 at which finished prints are collected. An optional pressure fusing or fixing mechanism, indicated generally at 96, may be provided to apply pressure to ink spots on print media to flatten and spread the ink spots as the media exits along the pathway 92 toward the collection tray 94. In one exemplary form of a pressure application mechanism, a pair of longitudinally extending pressure rolls 98, 100 bear against one another and define a nip 102 therebetween. Preferably one or both of these pressure fusing rolls 98, 100 are driven in rotation, as indicated by the respective arrows 104, 106 to move the print media through the pressure fusing rolls. These pressure rolls are typically loaded by applying a load to shafts at the respective end of one of these rolls, to provide a high fusing pressure, such as of 100 lbs. per lineal inch, along the line of engagement between the pressure roll and print media. Although the rolls 98 and 100 may be of a rigid material such as steel, preferably at least one of these rolls has a rigid core surrounded by an elastomeric material, such as described in U.S. Pat. No. 5,092,235 to James D. Rise, entitled Pressure Fixing and Developing Apparatus, filed May 24, 1989, and incorporated herein in its entirety by reference.

Alternatively, the pressure fusing apparatus may take the form of a relatively small pressure wheel which is urged into engagement with print media on the drum at the location of the exit 90. In this case, the drum 40 would back up the print media at the location where the media is engaged by the pressure wheel. The pressure wheel may also, for example, engage the print media after the print media has left the surface of the drum and while the print media is backed by a surface other than the drum surface. In the case of a small pressure wheel, the wheel is generally mounted for rotation about an axis which is orthogonal to the axis of drum 40 and is moved transversely from side to side of the print media in repeated passes across the media. A typical pressure wheel has a width of less than one inch, and preferably less than one-half inch, with one-quarter inch being a specific preferred example. These wheels may be of any suitable material, such as stainless steel or a plastic material such as Delrin® from Dupont Corporation. Again, these small wheels are typically loaded to provide the desired line loading force of 100 lbs. per linear inch when the wheel is shifted against the print media. This type of pressure applicator is described in U.S. Pat. No. 5,092,235. Again, the pressure fusing or fixing devices such as 96 are most preferably included when the print media is being printed with phase-change or hot-melt ink.

With continued reference to FIGS. 1–5, the printer includes a sheet holding and delivery mechanism 110 which may conveniently comprise a print media holding cassette which operates in a conventional manner to selectively place one sheet of media in position for engagement by a driven scuff wheel 112. The wheel 112 has a central shaft 114 rotatably mounted to the printer frame. The scuff wheel is selectively driven in the direction of arrow 116 by a motor, not shown, to pick up a sheet of print media from the cassette tray and feed it to the printer.

From scuff wheel 112, the print media passes between a pair of guides 118, 120 and into a nip 122 between a frame mounted idler roller 124 and a frame mounted transport drive roller 126. Each of these rollers 124, 126 is rotatably mounted to the printer frame with roller 126 being driven selectively by drive motor, not shown, in the direction of arrow 128 during transportation of the print media to the drum. The apparatus also includes a paper clamp guide 130, which in the illustrated form comprises a generally U-shaped guide having a first leg 132 pivoted at an end 134 to the printer framework. The clamp guide has a second leg 136 with a planar print media guide surface 138. The surface 138 is oriented at an acute angle with respect to a line tangent to the surface of the drum at the location of the clamp guide for directing the edge 24 of a sheet of print media impinging on the surface 138 toward the clamp 50. The base 139 of the clamp guide 130 has a notch 140 at the intersection of the base and leg 136. The notch 140 is engaged by the gripping edge 54 of clamp 50 when the clamp is in the open position as indicated in FIG. 1. Under these conditions, rotation of the drum 40 in the direction of arrow 46 shifts the clamp guide 130 away from the drum surface and places the guide surface 138 in position for directing print media to the clamp.

Additional print media transportation guide surfaces are also provided at a lower region of the printer as indicated at 150 and 152 in FIG. 1. Also, the print media exit 90 is bounded by an elongated print media guide 156 and another guide 158 so as to define a guide channel which also comprises a portion of the exit pathway 92. A pair of spaced apart stripper guides 160, 162 define another portion of the exit pathway 92. The guides 160, 162 engage the surfaces of the respective rollers 98, 100 to strip print media from these rollers in the event the media becomes stuck thereto during the fusing operation. The stripper guides 160, 162 typically comprise resilient sheets of stainless steel or other material. Yet another guide 166 adjacent to the stripper guide 162 may be provided for use in continuing the guiding of print media exiting from the printer to a selectively driven exit roller 168. The exit roller is driven by a motor, not shown, in the direction of an arrow 170 to carry a sheet of print media to the collection tray 94 following printing. Of course, it will be apparent to those of ordinary skill in the art that the various guides illustrated in FIG. 1, may be modified as desired to minimize the possibility of print media hanging up or jamming in the printer.

Referring again to FIG. 1, an elongated contact roller 180 is positioned as shown with a longitudinal axis generally parallel to the longitudinal axis of the drum 40. Like the drum 40, the contact roller 180 is typically journaled to rigid frame elements, one being indicated at 181 in this figure. The contact roller 180 may have a shaft 182 coupled to these frame elements. The respective ends of the shaft 182 are typically loaded with a weight (not shown) of up to about two pounds with this load being adjustable if desired. As a result, the contact roller 180 is held against the drum 40 with a nip 184 being defined in the print media transportation path at the location where the contact roller 180 engages the drum. During operation of the printer, the print media 22 passes through this nip during portions of the printing cycle and is retained against the drum by the contact roller.

The positioning of the drum 40 may be accomplished by any of the known mechanisms for arresting the rotation of the rotating body at a specific location, such as shaft angle encoding sliding switch contact, optical sensing or the like. As explained below, a stepper motor, timing pulleys and timing belt drive mechanism is preferably used to provide accurate motion of the drum. In addition, optical sensors, not shown, may be utilized to sense the print media on the drum and at various locations throughout the printer to detect print media jams and the like.

The operation of the above described printer apparatus will be described below following the description of one preferred form of the tensioning blade, drum, and clamp assemblies.

Figures 9, 10:
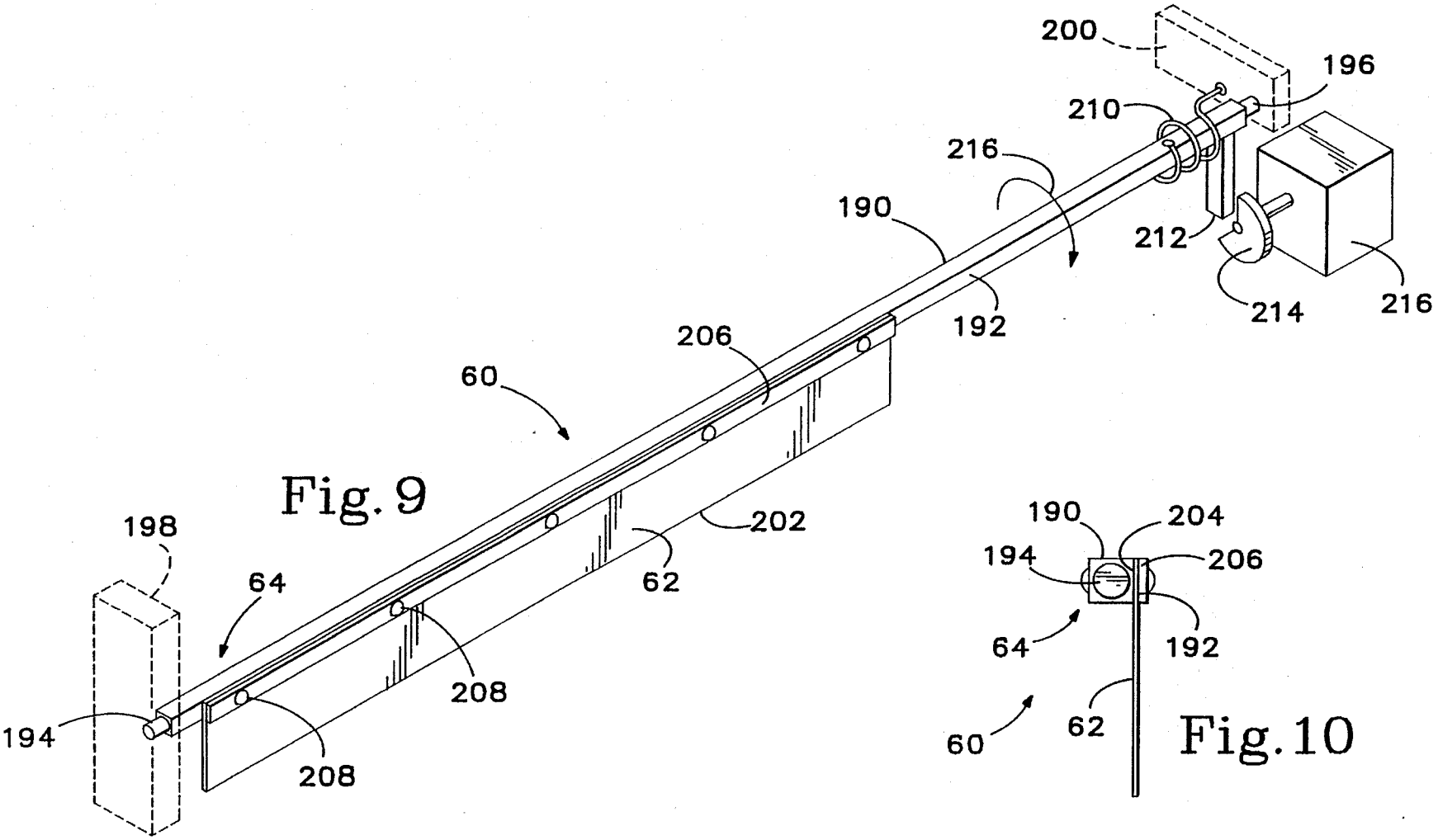
FIG. 9 is an isometric view of a tensioning blade assembly in accordance with the present invention and showing, in schematic form, a drive mechanism for pivoting the tensioning blade.
FIG. 10 is an end view of the tensioning blade assembly of FIG. 9.

The illustrated back tensioning blade assembly 60 is best shown in FIGS. 9 and 10. This assembly includes a rigid shaft 190, such as of steel, which may be of a square cross section to provide a planar blade mounting surface 192. The respective ends of shaft 192 are round, as indicated at 194 and 196 and are journaled to respective frame sections indicated schematically in dashed lines at 198 and 200. Although other configurations may be used, the blade 62 is preferably rectangular with a lower edge 202 and an upper edge margin 204 positioned against the flat mounting surface 192 of shaft 190 (see FIG. 10). An elongated retainer bar 206, held in place by fasteners, such as rivets 208, clamps the tensioning blade 62 to the shaft 190 along the entire length of the tensioning blade to securely mount the tensioning blade in place.

The lower edge 202 of the tensioning blade is biased against the print media and drum, as by a torsion spring 210 secured at one end to shaft 190 and at its other end to the printer framework 200. The torsion spring typically applies a load of from 2–6 lbs., and most preferably about 5 lbs. against the blade. A cam, shown schematically at 212 in FIG. 9 as a flange projecting downwardly from shaft 190, is engaged by a cam actuator, indicated schematically at 214 in FIG. 9, to rotate the shaft 190 in the direction of an arrow 216 to shift the blade 62 away from the drum. A motor 216 is operated for this purpose with motion of the cam actuator 214 being limited by stops, not shown. When the motor is de-energized, the cam actuator 214 returns to its original position with the spring 210 again biasing the blade against the drum.

It should be noted that other forms of print media tensioning devices may be employed, such as a friction roller/slip clutch. However, the preferred tensioning mechanism comprises the aforesaid described tensioning blade assembly 60 which constitutes a simple mechanism for applying a substantially uniform tensioning pressure against the entire width of the print media on the drum.

The drum 40 may be of any convenient construction. However, FIGS. 11 and 12 illustrate one preferred form of a drum. This drum 40 is comprised of a rigid material, such as aluminum or stainless steel, and preferably comprises a relatively thin shell 220 mounted to the shaft 42. Plastic would be another exemplary material. As a specific example, the drum may be comprised of 0.05 inch thick aluminum. In addition, a 0.004 inch thick nickel plating or other highly reflective surface may be placed on the drum. This facilitates optical sensing (using retro-reflective optical sensors) of the edges or boundaries of print media on the drum as the print media is less reflective than the drum surface. Optical sensors have a greater resolution in distinguishing between a reflective drum and diffusely reflective media than between an absorptive (e.g. black) and more reflective media. Also, a wider variety of media, in particular dark colors, may be sensed on a reflective drum. Also, a highly thermally conductive high thermal media support, such as a drum of aluminum, results in excellent printer quality when hot-melt inks are used due to the rapid solidification on such a drum. In comparison to a 0.005 inch stainless steel drum, the peak media temperature on the aluminum drum was 15° C. lower than on a stainless steel drum. Also, such a drum reduces non-uniform expansion and wrinkling of print media, such as when such media is subjected to heat.

A pair of circular end bells 222, 224 are coupled to and support the outer shell 220. The shaft 42 in this case comprises a pair of shaft sections each extending through one of the respective end bells. Bearings 230 journal the respective shaft sections 42 to supporting portions of the printer framework indicated generally at 232 in FIG. 11. As best seen in FIG. 12, the end bells are each provided with spokes 234–240, the respective opposed spokes 240 each being provided with a clamp mechanism receiving opening 242 through which the clamp assembly (described below) is inserted and retained. The resulting drum has a low rotational inertia, thus permitting rapid damping of any rotational vibration caused by rotation of the drum during printing.

To provide accurate printing, the radius of the drum is extremely uniform and is preferably within a tolerance of plus or minus 0.002 in. In addition, and although not necessary, the drum exterior surface may have an optional high friction surface, such as provided by a pair of circumferentially extending bands, indicated at 250 in FIG. 11 having a relatively high co-efficient of friction, with a most preferred surface having a co-efficient of friction of at least about one.

The illustrated drum 40 also includes plural clamp mechanism receiving slots 252 for receiving the leg portion 56 of the clamp 50 (FIG. 1) as described below in connection with FIGS. 13 and 14. Also, the drum may be provided with a slot 254 which may be sensed, as by an optical sensor, to confirm the rotational position of the drum during printing. The drum may also include a compression spring 256 and spacer 258 mounted to one of the shaft sections 42 for the purpose of assembly.

Any suitable drive mechanism may be used for rotating the drum 40. For example, a motor may be connected directly to the drum shaft 42. Also, if an elongated fusing roller is used with the drum serving as a backup for the roller during fusing, a single drive mechanism for rotating the drum also rotates the fusing roller due to its contact with the roller. That is, in such a case the drum in effect drives the fusing roller. Although these alternatives may be used, a preferred drive mechanism utilizes inexpensive components to achieve extremely precise motion of the drum 40 and print media thereon.

With specific reference to FIG. 11, the illustrated drive mechanism includes a conventional stepper motor 260 having an output shaft 262 which is rotated through an incremental angle with each drive pulse applied to the stepper motor. A stepper motor of this type is designed to have its output shaft incremented by a predetermined number of steps for each complete revolution of the output shaft. As a specific example, the output shaft of a 200 step per revolution stepper motor would travel through an angle of 1.8 degrees for each step. By selecting a commercially available stepper motor having a non-cumulative error design within prescribed limits, such as a five percent non-cumulative error, the stepper motor will be within the prescribed error of 1.8 degrees of its theoretical position at the end of any number of steps. One suitable stepper motor is a PH266 series motor available from Oriental Motors Co., Ltd. of Japan.

A first timing belt sprocket 264 is fixedly mounted to the output shaft 262. A second timing belt sprocket 266 is coupled to the drum 40, such as being rigidly mounted to the shaft section 42 of the drum. Both of these timing belt sprockets include plural teeth. A timing belt 268 is coupled to the timing belt sprockets 264, 266 for transferring incremental motion from the output shaft 262 to the drum 40. One specific example of a suitable timing belt is a commercially available belt made by Chemi-Flex of Lombard, Ill. and is of urethane with an aramid core. Timing belts are easy to tighten and virtually eliminate backlash.

Because the timing belt 268 typically engages at least seven or eight teeth of each of the timing belt sprockets, tooth averaging is achieved. That is, any inaccuracies in the individual teeth of the timing belt sprockets are in effect averaged because the timing belt engages multiple teeth simultaneously. Also, because of the ratio of teeth between the sprocket 266 and the sprocket 264, with the sprocket 266 typically having many more teeth than the sprocket 264, a substantial reduction in the inertia of the drum is reflected onto the output shaft 262, thereby minimizing the loading, wear and potential slipping of this output shaft and providing an improved inertia matching of motor to load. For example, with 180 teeth on a timing belt sprocket 266 and 30 teeth on the timing belt sprocket 264, a six-to-one motion reduction is achieved and a thirty six-to-one inertia reduction. Although not shown, one or more intermediate timing belt sprockets may be utilized together with plural timing belts to transfer the motion from the stepper motor 260 to the drum.

The circumference of the drum 40 and the ratio of the teeth on the sprockets 266 and 264, as well as on any intermediate sprockets, if used, together with the distance to which the output shaft is incremented with each step of the stepper motor, may be selected such that the exterior surface of the drum is rotated through a distance which is substantially equal to a multiple of the pixel height with each step of the stepper motor. That is, printers typically print in lines having picture elements or pixels with a predetermined height and a predetermined width. By selecting components of the drive mechanism to advance the print media a distance which is equal to one or more pixels, and preferably an integral multiple of the height of an individual pixel, it has been found that banding of the printed image on the print media is substantially eliminated. Banding refers to a phenomenon whereby ink printed by an ink jet printer is not uniformly applied inasmuch as undesired overlapping or underlapping of ink occurs in printed lines, causing a banding or non-uniform appearance of the printed image. By accurately advancing the print media a multiple of the pixel height as the ink jet print head makes successive passes across the print media, any banding is virtually undetectable to the human eye. Typically, an ink jet print head prints multiple lines of ink in one pass. Thus, when a particular group of lines is fully printed, the print media is advanced a sufficient number of pixels to present previously unprinted media in position for printing. As shown in FIG. 5, with this approach, printing is accomplished in a serpentine path with the ink jet print head making one or more passes across a portion of print media in the printing zone and the print media then being advanced to position additional unprinted media in position for printing.

With a five percent non-cumulative stepper motor, with pixels 0.003333 inch high and with the printer printing at 300 drops per inch, it has been found that the print media is positioned within approximately one-tenth of a pixel of its theoretical location. With a more accurate stepper motor than a five percent non-cumulative error motor, even greater accuracies in print media advancement can be achieved. Furthermore, this accuracy is also enhanced by the fact that the print media is maintained taut by the back tensioning mechanism in the printing zone.

Figure 13:
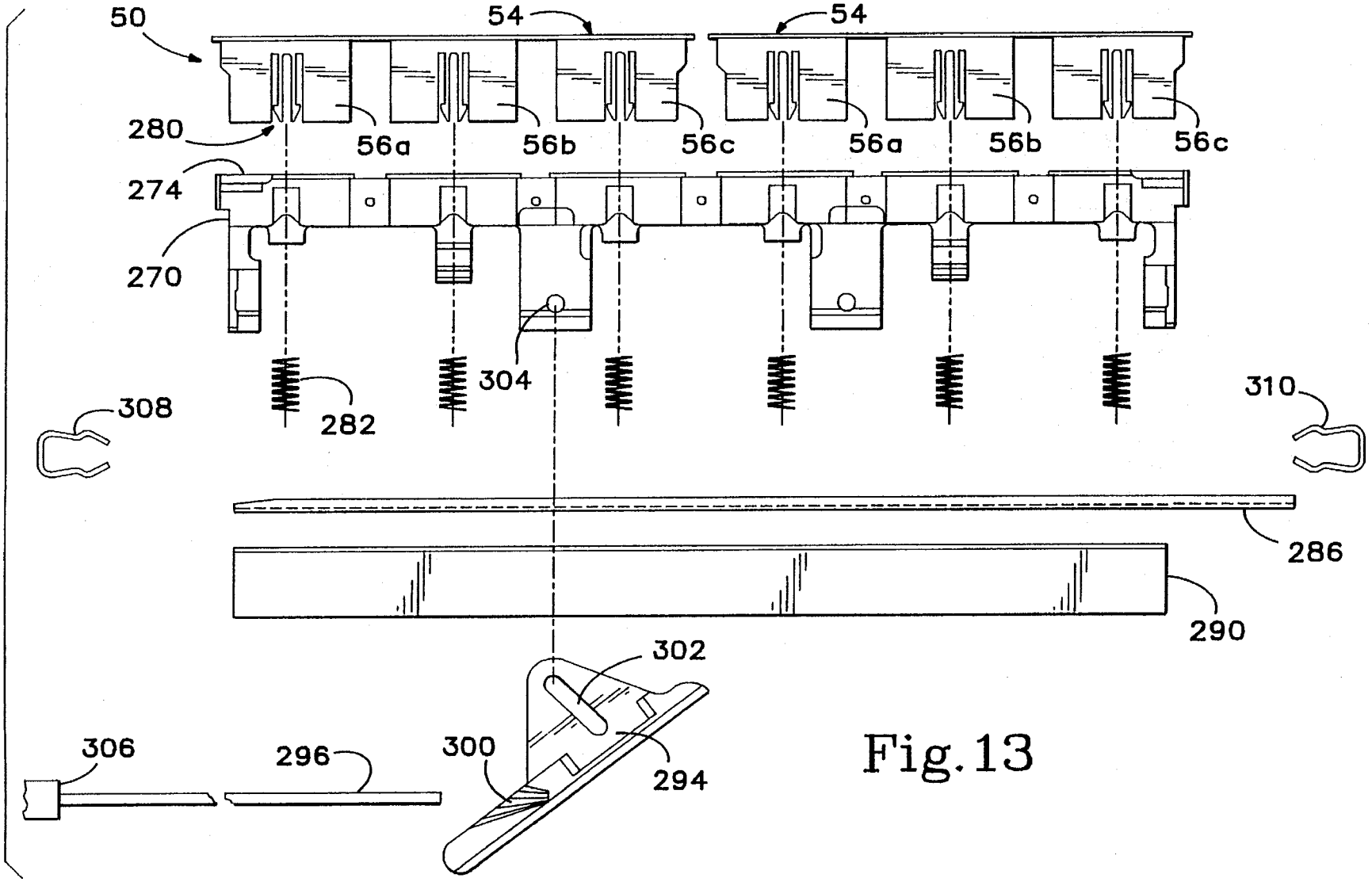
FIG. 13 is an exploded view, taken from the side, of one form of a print media clamp used in the present invention.
Figure 14:
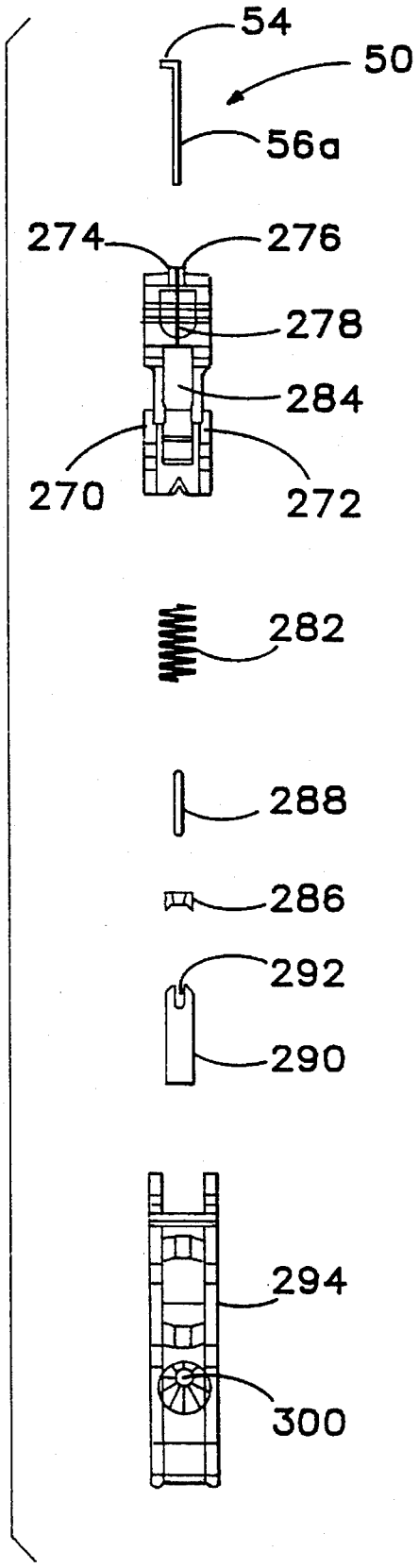
FIG. 14 is an exploded end view of the clamp of FIG. 13.

Although any suitable clamp mechanism may be used, a preferred form of clamp 50 is illustrated in FIGS. 13 and 14. The purpose of the media clamp 50 is to hold the leading edge 24 of the print media between the print media grip edge 54 and the drum surface. The clamping force must be large enough to prevent the leading edge of the media from moving or pulling out of the clamp during printing and is preferably from 8 lbs. to about 10 lbs. The media clamp is opened and closed at various drum rotational positions during the handling of the print media as explained below. In general, with the clamp in the print media receiving position (see FIG. 1) the print media is over-driven into the open clamp to form a de-skewing buckle that aligns the leading edge 24 of the media with the clamp. When the clamp is closed, the print media is clamped to the drum surface in the proper orientation, independent of the media orientation in the feed rollers 112, 124 and 126. After the image is printed on the print media, the media clamp is opened, and the drum rotates to transfer the media to the exit system of the printer.

It is preferable that the media clamp be able to hold a wide variety of media types and sizes, such as varying in thickness from about 0.003 to 0.011 inches and in width from about 4 to about 12 inches, on the drum surface without interfering with the printing or print media handling function of the printer. To prevent contact between the moving ink jet print head 14 and the paper grip clamp, the thickness of the paper grip clamp 54 must be less than the nominal gap between the print head and the print media surface, such as a 0.032 inch gap. Although these dimensions may be varied, a grip clamp 254 which is 0.012 inch thick and of stainless steel results in a nominal 0.019 inch gap between the ink jet print head and the grip clamp 54 when media is absent. Of course, these dimensions may be varied for particular applications.

Assuming it is desired to have a printer with the capacity to print to within a five millimeter (0.197 inch) margin on all four edges of the print media, the print media grip clamp 54 must have a width in the narrow direction which is less than this margin. In a specific embodiment of the present invention, this width dimension is 0.15 inch.

The specific clamp 50 illustrated in FIG. 13 includes a pair of clamp elements each with a respective print media grip portion 54 and leg portions **56*a*, 56*b* and 56*c* projecting downwardly from the gripping element with these leg sections being spaced apart. The leg sections are sized for insertion into associated slots 252 (FIG. 11) of the drum. A pair of identical clamp guides 270, 272 (one being shown in FIG. 13 and both being shown in FIG. 14) are positioned inside the drum 40 by inserting these guides through the opening 242 in the spoke 240 of the drum (see FIG. 12). These clamp guides have raised bosses 274, 276 (FIGS. 13 and 14) which fit within the respective drum slots 252. The components 270, 272, after being fastened together, for example by adhesive or other bonding techniques such as ultrasonic bonding, provide slots, such as the one indicated at 278 in FIG. 14, for receiving the respective leg sections 56*a*–56*c* of the clamping elements. Each of the clamp element leg sections includes a spring retainer, such as a split barbed retainer, one being indicated at 280 in FIG. 13. Respective springs, one being indicated at 282 in FIGS. 13 and 14, are positioned in a spring retaining guideway (see 284 in FIG. 14) and on the spring retaining element (e.g. 280) to bias the clamp gripping element 54 to a closed or clamped position against the drum. A removable spring retaining fork, indicated at 286, is used to maintain the springs in a compressed state during assembly of the clamping mechanism. Guide pins 288** are included alignment purposes.

A lift bar 290 has a deep groove 292 (see FIG. 14) along its top surface which engages the bottom edges of the clamp leg sections **56*a*–56*c* during the raising of the lift bar to open the clamp. When the lift bar is in the lowered or clamp closed position, a nominal gap, for example 0.025 inch is provided between these elements to assure that the full compressive force of the springs is used in holding the print media to the drum surface. The lift bar is actuated by a clamp pivot 294 which transfers the horizontal motion of a push rod 296, inserted through an opening 298 in one of the shaft sections 42 (see FIG. 12) and into engagement with a rod receiving socket 300 of the clamp pivot. The clamp pivot is provided with an elongated slot 302 which is press-fit onto clamp guide pins at location 304 in FIG. 13. The elongated slot 302 allows the clamp pivot to slide relative to the pins so that the assembly may be inserted through the opening 242 in the spoke 240 of the drum bell housing (FIG. 12). The push rod is driven, as by being attached to a lead screw of a printer frame mounted gear motor as indicated schematically in FIG. 13 at 306. With this arrangement, at any rotational position of the drum, the clamp 50 may be opened by raising the lift bar 290 to space the print media gripping element 54 away from the drum surface. Spring clamps 308, 310** are used to releasably retain the media clamp assembly within the drum.

As previously mentioned, many drum clamping mechanisms have been proposed for clamping print media to a drum surface. Although the illustrated form of clamping mechanism is preferred, due to its relatively small number of parts and reliability, other drum clamping mechanisms may, of course, be used.

Referring again to FIGS. 1–8, a method of operating a printer to print ink jet print media will next be described. In accordance with the method, print media is fed one sheet at a time from the print media cassette to the waiting paper clamp 50 on the drum. With reference to FIG. 1, the ink jet print head 14 and associated reservoir 16 is not visible in this figure because they are shifted to a position clear of the portion of the drum which supports the print media. In addition, the drum is rotated in the direction indicated by arrow 46, if necessary, to position the clamp 50 at a home location for receiving a sheet of print media. The open clamp 50, and more specifically the print media grip element 54, engages and shifts the guide 130 to its guide position as a result of this drum rotation. The sheet of print media 22 is picked up by roller 112 and driven to the nip 122 between the idler roller 124 and driven roller 126. At such time, the driven roller 126 is typically initially stopped to cause the print media sheet to buckle, as indicated at 320, as it reaches the nip 122. Consequently, the leading edge 24 of the print media undergoes a preliminary alignment at the rollers 124, 126. The roller 126 is then driven in the direction of arrow 128 to transport the print media sheet 22, and more specifically the leading edge 24 of the sheet, into the open clamp 50 as shown in FIG. 1. Again, the print media sheet may be overdriven slightly by the roller 126 to cause another buckle in the sheet, indicated at 322, to assist in aligning the leading edge 24 of the print media against the leg 56 of the open clamp 50. The clamp 50 is then closed to clamp the sheet to the drum.

Although this may be accomplished earlier in the sequence, the back tension spring or blade 62 is then opened, as shown in FIG. 2, and the drum is rotated roughly about 90 degrees in the direction of arrow 44 (FIG. 2) so that the clamp draws at least a portion of the print media sheet 22 onto the drum. The guide 130 also assists in maintaining the print media on the drum. When the print media reaches the printing zone P, as shown in FIG. 4, the tensioning blade 62 is positioned against the print media as the clamp gripping element 54 has now passed the location 80 at which the tensioning blade engages the drum. In addition, the ink jet print head 14, and reservoir 16 if coupled thereto, are shifted to a position for printing on print media 22 within the printing zone. Printing is accomplished by moving the ink jet print head transversely from side to side of the print media, ejecting ink onto the media, and advancing the drum preferably by distance equal to the number of pixels being printed with each pass or passes of the ink jet print head over a particular section of media (16 pixels being one typical example). The print head may be reversed after reaching the side edge of the print media to again scan the print media in the opposite direction to print another row of pixels. Thus, a serpentine printing path, see FIG. 5, results. Of course, although faster, bi-directional printing is not required and other print head scanning sequences may be used.

Printing continues in this specific example as the drum is rotated incrementally in the direction of arrow 54 until the trailing edge 26 (see FIG. 6) reaches location 80 under the back tension spring. The printing process is now complete and the back tension spring blade 62 is opened (see FIG. 7). The drum 40 continues to rotate in the direction of arrow 44 until the trailing edge 26 of the print media sheet is at about the two o'clock position. It should be noted that prior to opening the tensioning blade, the ink jet print head 14 and reservoir 16 is again shifted to a home position at one end of the drum and away from the portion of the drum supporting the print media. Also, the light pressure roller 180 assists in retaining the print media on the drum.

Next the drum 40 is rotated in the direction of arrow 46, that is the direction of drum rotation is reversed in comparison to the direction during printing, to deliver the trailing edge 26 of the print media to the exit 90 of the printer. Continued rotation of the drum in this reversed direction delivers the print media through the fusing apparatus 96, if used, and to the exit roller 168 for transport to the output tray 94 by the exit roller. The clamp 50 is opened (see FIG. 8) following the passage of the edge 26 of the print media sheet into the nip 102 of the fusing rollers 98, 100 if the fuser or pressure fixing mechanism is used. Alternatively, the clamp is opened when the print media sheet edge 26 reaches the exit roller 168. Again, optical or other sensors may be used to monitor the position of the print media within the printer. For example, an optical sensor may be located at exit roller 168 to determine when the edge 26 reaches the exit roller with the clamp being opened upon detection of the print media sheet at this location.

Having illustrated and described the principles of our invention with reference to one preferred embodiment, it should be apparent to those of ordinary skill in the art that this invention may be modified in arrangement and detail without departing from such principles. We claim as our invention all such modifications as fall in the scope and spirit of the following claims.

We claim:

1. A method of printing sheets of print medium with hot-melt ink from an ink jet print head having at least one orifice from which hot-melt ink is ejected toward the print medium carried by a rotatable thermally conductive drum, each sheet of print medium having a first edge, a second edge opposed to the first edge, and a pair of transversely spaced apart side edges, the ink jet print head being movable in a transverse direction, the method comprising the steps of:

moving the ink jet print head to a home position spaced from the portion of the thermally conductive drum carrying the print medium, the drum having a continuous support surface;

rotating the thermally conductive drum to position a drum-mounted clamp to a print medium receiving position;

feeding the print medium to deliver the first edge of the print medium to the clamp and causing the print medium to buckle to align the first edge to the clamp;

clamping the first edge of the print medium in the clamp and to the continuous support surface of the thermally conductive drum;

rotating the thermally conductive drum in a first direction to position the print medium in a printing zone and at a start print position;

applying a back-tension to the print medium to wrap the print medium from the first edge of the print medium to the second edge of the print medium about the drum;

moving the ink jet print head transversely in repeated passes back and forth across the print medium while moving the thermally conductive drum in the first direction to transport the print medium through the printing zone while ejecting hot-melt ink from the ink jet print head to print on the medium;

returning the ink jet print head to the home position;

releasing the back-tension to the print medium;

reversing the direction of the thermally conductive drum such that the second edge of the print medium travels in a second direction to deliver the second edge of the print medium to an exit path and along the exit path from the thermally conductive drum and releasing the clamp to permit a transfer of the print medium from the drum to the exit path and;

delivering the print medium to pressure fusing apparatus to pass the medium therethrough to pressure fuse the hot-melt ink to the print medium.

2. A method according to claim 1 in which the step of rotating the thermally conductive dram to position the print medium in a printing zone further comprises the step of drawing the print medium through the printing zone with tension resisting the movement of the print medium through the printing zone to thereby draw the print medium taut as the print medium is transported through the printing zone.

3. A method according to claim 2 in which the applying tension step comprises the step of positioning a tensioning blade against the print medium and the thermally conductive drum, the blade extending transversely across the print medium.

4. A method according to claim 3 including the step of pivoting the blade away from the thermally conductive drum to permit travel of the clamp in the first direction past the blade following the clamping step.

5. A method according to claim 3 further including the step of pivoting the blade away from the thermally conductive drum prior to the step of reversing the direction of rotation of the thermally conductive drum to deliver the second edge of the print medium to the print medium exit path.

6. A method according to claim 1 comprising the step of fusing the print medium as the print medium passes along the exit path from the drum.

7. A method according to claim 1 including the step of applying back tension to the print medium as the print medium is printed.

8. A method according to claim 7 in which the step of applying back tension to the print medium comprises the step of positioning a transversely extending tensioning blade against the print medium as the print medium is transported through the printing zone.

9. A method of printing sheets of print medium according to claim 1 further comprising the step of feeding the medium to feed roller, the print medium buckling to align in the feed roller.

* * * * *